US006496563B1

(12) United States Patent
Bacon

(10) Patent No.: US 6,496,563 B1
(45) Date of Patent: Dec. 17, 2002

(54) X-RAY TUBE DRIVER

(76) Inventor: Christopher M Bacon, 4 Lauren Ave. South, Dix Hills, NY (US) 11746

( * ) Notice: Subject to any disclaimer, the term of this patent is extended or adjusted under 35 U.S.C. 154(b) by 0 days.

(21) Appl. No.: 09/407,049

(22) Filed: Sep. 27, 1999

(51) Int. Cl.[7] ..... H05G 1/10
(52) U.S. Cl. ..... 378/101; 714/57; 318/254
(58) Field of Search ..... 378/101; 714/57; 318/254

(56) References Cited

U.S. PATENT DOCUMENTS

| | | | | |
|---|---|---|---|---|
| 3,195,038 A | | 7/1965 | Fry | |
| 3,711,747 A | | 1/1973 | Sahara et al. | |
| 3,938,031 A | | 2/1976 | Blackmond | |
| 5,589,760 A | | 12/1996 | Lee | |
| 5,990,640 A | * | 11/1999 | Dwyer et al. | 318/254 |
| 6,025,679 A | * | 2/2000 | Harper et al. | 315/312 |
| 6,067,645 A | * | 5/2000 | Yamamoto et al. | 714/57 |

* cited by examiner

*Primary Examiner*—David V. Bruce
*Assistant Examiner*—Pamela R. Hobden
(74) *Attorney, Agent, or Firm*—Michael I. Kroll

(57) ABSTRACT

A driver circuit for supplying power to an X-ray tube includes a filament supply, a first transformer connected to an anode of the X-ray tube and a first switch connected between the driver control and first transformer. The driver control controls the first switch to move between an open and closed position. The signal applied to the first transformer when the switch is closed is adjustable in both frequency and pulse width and is applied to the X-ray tube to generate an adjustable X-ray beam. The first transformer includes a primary winding connected to the first switch and a secondary winding connected to an anode of the X-ray tube, a voltage to be induced in the secondary winding is applied to the anode of the X-ray tube for generating the X-ray beam. The X-ray tube driver may further include a second switch, a second transformer connected between the second switch and driver control and a third transformer connected in parallel with the filament of the X-ray tube, the second transformer being connected to the cathode and in series with the parallel connection of the third transformer and ground. The second transformer applies a negative voltage to the cathode. The driver circuit is able to provide a high voltage pulse having a width within a range of 100–200 μsec. The high voltage pulse is adjustable to generate a voltage within a range of 0–40 k and a range of 0–80 kV when the second and third transformers are connected.

21 Claims, 5 Drawing Sheets

X-RAY TUBE DRIVER

BACKGROUND OF THE INVENTION

1. Field of the Invention

The present invention relates generally to X-ray tubes and, more specifically, to a driver for powering an X-ray tube able to provide constant and adjustable power to the X-ray tube without significant thermal buildup from the creation of X-rays.

2. Description of the Prior Art

Numerous types of power supplies have been provided in the prior art. For example, U.S. Pat. Nos. 3,195,038; 3,711,747; 3,938,031 and 5,589,760 all are illustrative of such prior art. While these units may be suitable for the particular purpose to which they address, they would not be as suitable for the purposes of the present invention as heretofore described.

This invention relates to a voltage or current regulator apparatus, e.g. variable ratio transforming apparatus for the conversion of electrical energy from one voltage or current to another. The invention includes a plurality of transformer windings or sources of alternating current, a plurality of switch means associated with the windings. Each switch is changeable between a condition in which it connects the associated winding or source into a circuit and a condition in which the associated winding is by-passed in the circuit without being short circuited. A control device causes the switches to connect one or more of the windings in series.

A power supply for use with different AC line voltages, which includes a power transformer having a plurality of separate primary windings and a corresponding plurality of fuses connected thereto. The primary windings are connected to each other in several different ways to change the turns ratio of the power transformer depending upon the value of the voltage supplied thereto. Thus, a predetermined voltage is produced in the secondary winding of the transformer irrespective of the value of the supplied AC line voltage and the current flowing through each of the fuses is held substantially constant, during normal operating conditions, regardless of the manner in which the separate primary windings are connected.

An adjustable voltage alternating current power supply is provided which is especially suitable for supplying loads of variable resistance. The power supply consists of a transformer having two secondary windings with solid-state switches for alternatively connecting the secondary windings in either parallel or series, and with a firing control circuit for changing the connection of the windings from parallel to series at a predetermined point in each half-cycle of the voltage to adjust the effective output voltage so that constant output power can be maintained, or the output power can be varied in any desired manner.

A voltage converter for traveler's uses includes: a 50 watt (0–50 W) transformer for converting an input voltage of 220 VAC to an output voltage of 110 VAC for normally powering a load of 50 watts or less; a 1600 watts (50–1600 W) transformer for converting an input voltage of 220 VAC to and output voltage of 110 VAC for powering a load ranging from 50 watts to 1600 watt; and a sensing control circuit operatively sensing an output load having a power rating larger than 50 watts (50 W to 1600 W) for operatively actuating a relay for automatically switching an output terminal of the 50 watts transformer to the output terminal of the 1600 watts transformer for preventing burning or damaging of the output load connected with the voltage converter and for protecting the voltage converter itself.

SUMMARY OF THE PRESENT INVENTION

The present invention relates generally to X-ray tubes and, more specifically, to a driver for powering an X-ray tube able to provide constant and adjustable power to the X-ray tube without significant thermal buildup from the creation of X-rays.

A primary object of the present invention is to provide a X-ray tube driver that will overcome the shortcomings of prior art devices.

Another object of the present invention is to provide a X-ray tube driver which is able to drive an X-ray tube directly using a high voltage transformer.

A further object of the present invention is to provide a X-ray tube driver which is able to provide the constant pulse to the X-ray tube without significant thermal buildup from the creation of X-rays.

A yet further object of the present invention is to provide a X-ray tube driver which is able to provide an adjustable pulse of 0–40 kV or 0–80 kV to an X-ray tube but not limited by these boundaries.

A still further object of the present invention is to provide a X-ray tube driver which is small and light weight.

An even further object of the present invention is to provide a X-ray tube driver which is able to vary the frequency of pulses to thereby change the number of X-rays generated per second.

A still further object of the present invention is to provide a X-ray tube driver which is able to vary the voltage of pulses thereby changing the amount of X-ray penetration through a desired object being X-rayed.

A yet further object of the present invention is to provide a X-ray tube driver which is able to vary output pulses over a set time to get the best possible image of the object being X-rayed.

Another object of the present invention is to provide a X-ray tube driver wherein there is no significant heat build up in the X-ray tube due to X-ray generation.

A still further object of the present invention is to provide a X-ray tube driver which is able to control the current, through the x-ray tube, of the voltage pulses thereby changing the amount of X-ray beam power through an object being X-rayed.

An even further object of the present invention is to provide a X-ray tube driver which is able to pulse an X-ray tube with at least 70 watt pulses without heat sinking the tube and preventing voltage tracking across the tube, but not limited to 70 watt pulses.

A further object of the present invention is to provide a X-ray tube driver that is simple and easy to use.

A still further object of the present invention is to provide a X-ray tube driver that is economical in cost to manufacture.

Additional objects of the present invention will appear as the description proceeds.

A driver circuit for supplying power to an X-ray tube including a filament supply, a first transformer connected to an anode of the X-ray tube and a first switch connected between the driver control and first transformer is disclosed by the present invention. The driver control controls the first switch to move between an open and closed position. The signal applied to the first transformer when the switch is closed is adjustable in both frequency and pulse width and is applied to the X-ray tube to generate an adjustable voltage and frequency for producing an X-ray beam. The first transformer includes a primary winding connected to the first switch and a secondary winding connected to an anode of the X-ray tube, a current to be induced in the secondary winding is applied to the anode of the X-ray tube for generating the X-ray beam. The X-ray tube driver may further include a second switch; a second transformer connected between the second switch and a cathode of the X-ray tube; and a third transformer connected in parallel with the filament of the X-ray tube, the second transformer being connected in series with the parallel connection of the third transformer connected to the cathode and ground potential. The second transformer applies a negative voltage to the cathode. The driver circuit is able to provide a high voltage pulse having a width within a range of 100–200 $\mu$sec but not limited to that range. The high voltage pulse is able to generate a voltage within a range of 0–40 k and a range of 0–80 kV when the second and third transformers are connected, but not limited to those ranges.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
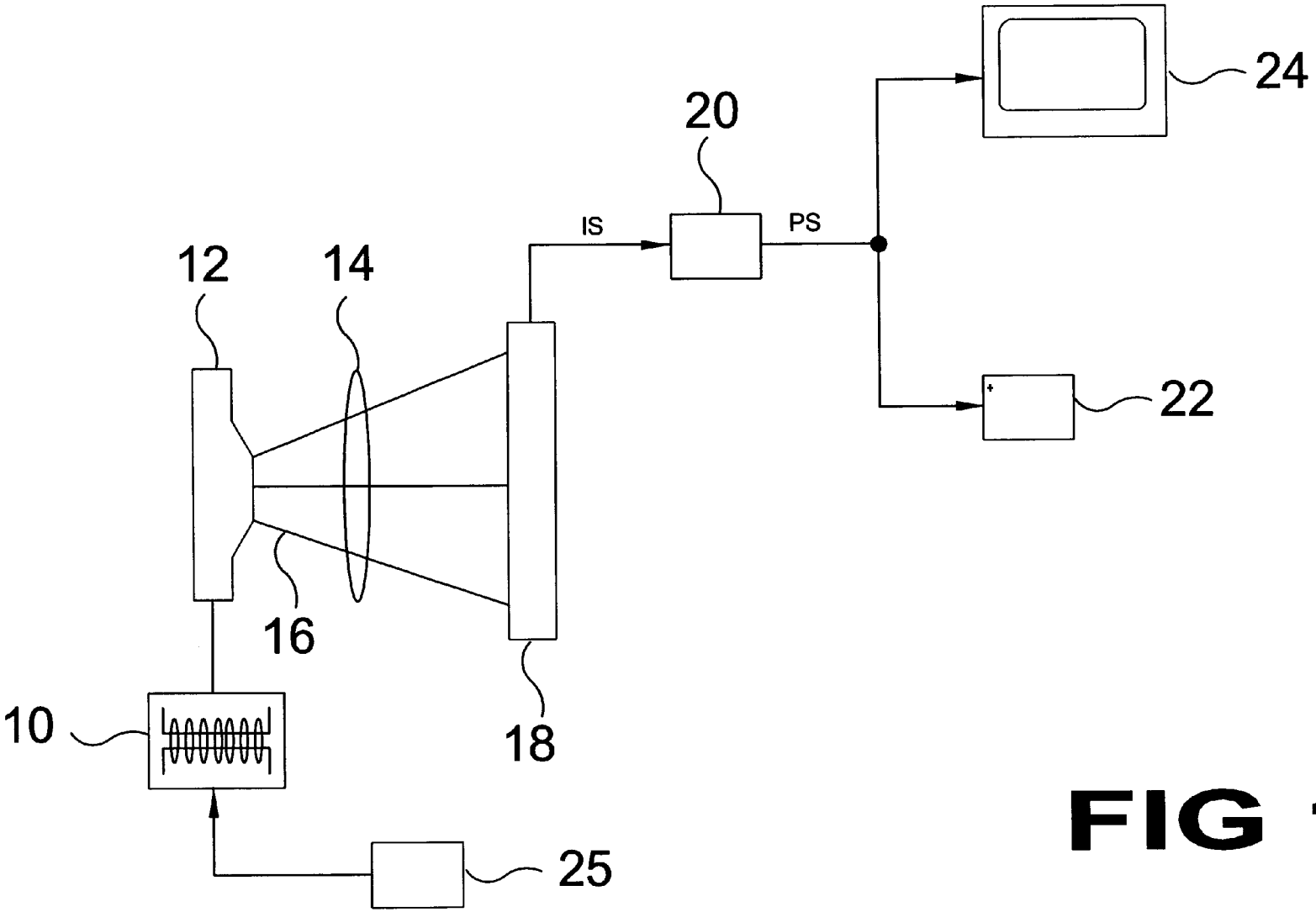
FIG. 1 is a perspective view of an X-ray examination apparatus being driven by the X-ray tube driver of the present invention.

Turning now descriptively to the drawings, in which similar reference characters denote similar elements throughout the several views, the Figures illustrate the X-ray tube driver of the present invention. With regard to the reference numerals used, the following numbering is used throughout the various drawing figures.

10 X-ray tube driver of the present invention
12 X-ray source
24 object being X-rayed
16 X-ray beam
18 X-ray detector
20 post processing unit
22 buffer unit
24 monitor
25 control device
26 tube
28 control section of X-ray tube driver
30 high voltage transformer
32 primary coil of transformer
34 secondary coil of transformer
36 switch
38 voltage supply
40 filament of X-ray tube
42 first transformer
44 primary coil of first transformer
46 secondary coil of first transformer
48 voltage supply
50 first switch
52 second transformer
54 primary coil of second transformer
56 secondary coil of second transformer
58 second switch
60 third transformer
62 primary coil of third transformer
64 secondary coil of third transformer
66 first timer
68 second timer
70 ground potential
72 anode of X-ray tube
74 transistor forming switch
76 gate of transistor
78 over current protection circuit
80 filament control and feedback circuit
82 cathode of X-ray tube
84 wiper of switch
100 X-ray driver circuit including two transformers
102 second transistor forming second switch
104 gate of second transistor
105 control winding

DETAILED DESCRIPTION OF THE PREFERRED EMBODIMENT

Turning now descriptively to the drawings, in which similar reference characters denote similar elements throughout the several views, FIGS. 1 through 5 illustrate the X-ray tube driver of the present invention indicated generally by the numeral 10.

The X-ray tube driver 10 of the present invention is shown in FIG. 1 connected to a system for taking an X-ray of an image. As can be seen from this figure, the X-ray tube driver 10 is connected to control a supply of power to an X-ray source 12. An object to be X-rayed is positioned between the X-ray source 12 and a screen 18. When power is supplied to the X-ray source 12 via the X-ray tube driver 10, the X-ray source 12 will generate an X-ray beam 16. The X-ray beam 16 will be directed towards the object 14 and the screen 18. An X-ray image of the object 14 will be generated on the screen 18 by the X-ray beam 16 passing through the object 14. The portions of the X-ray beam 16 able to pass through the object 14 will create the image on the screen 18. The screen 18 is connected to provide a signal representative of the image generated to a post processing unit 20. The post processing unit 20 will process the received signal and provide a processed signal to both a buffer unit 22 and a monitor 24. The monitor 24 is able to display the image on a screen for viewing. The buffer unit 22 is able to connect with a peripheral device for outputting a signal representative of the image signal thereto. If the peripheral device is a printer, the printer will then generate a hard copy output of the image or even a photographic image for viewing. A control device 25 is connected to the X-ray tube driver 10 for controlling the voltage, current and frequency of the electrical pulses supplied to drive the X-ray source 12.

Figure 2:
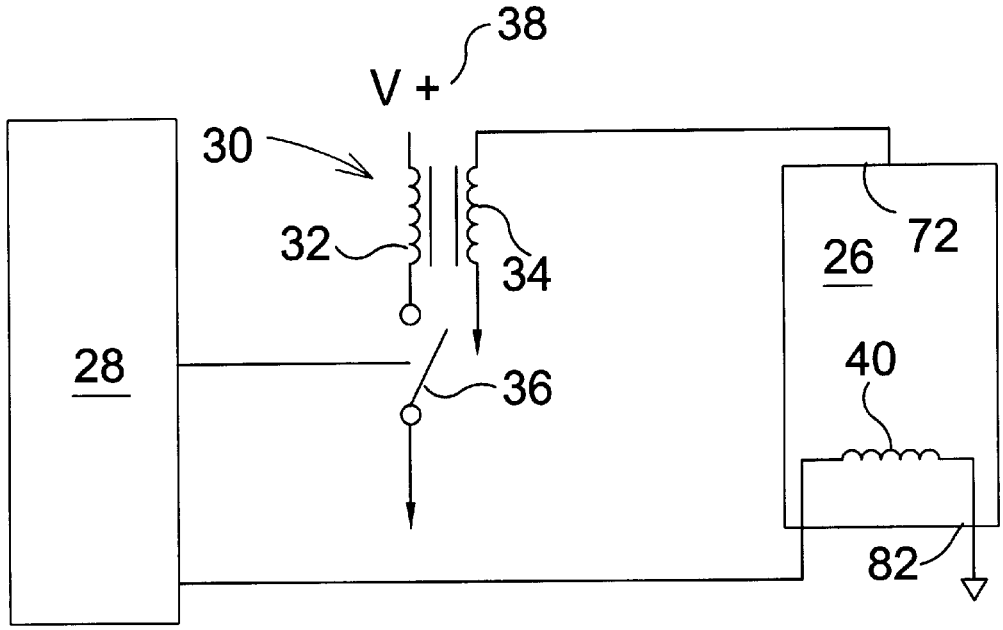
FIG. 2 is a block diagram of the X-ray tube driver of the present invention for generating power in a range of 0–40 kV.
Figure 2A:
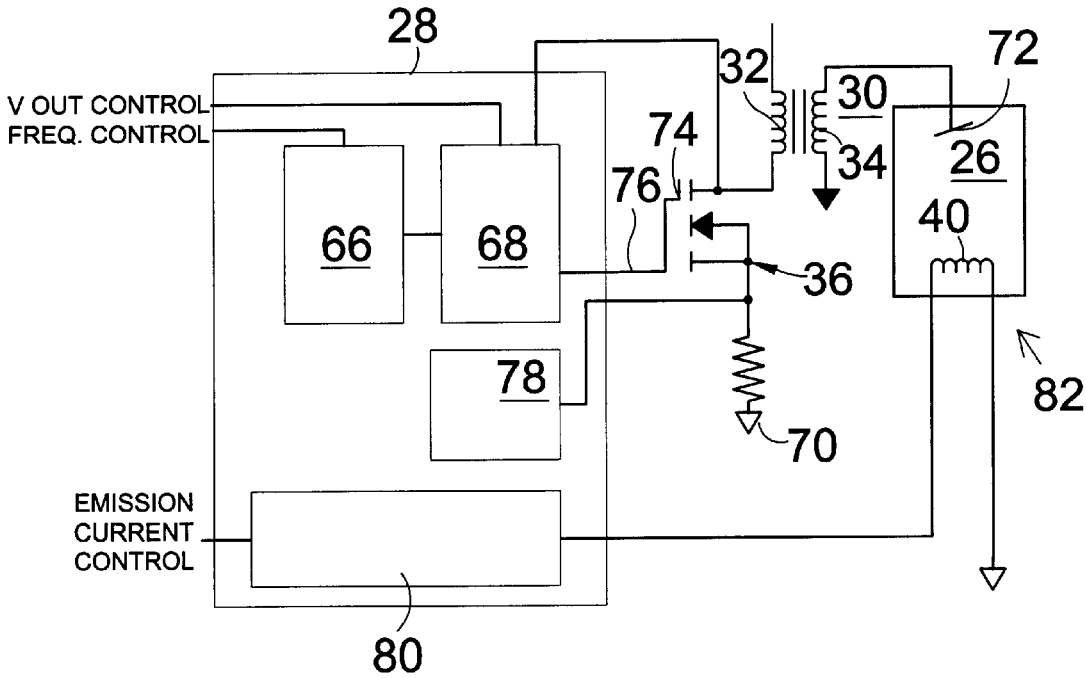
FIG. 2A is a schematic diagram of the X-ray tube driver of the present invention shown in FIG. 2.

FIGS. 2 and 2A illustrate schematic diagrams of the X-ray tube driver 10 of the present invention connected to a X-ray tube 26. As can be seen from these figures, the X-ray tube driver 10 includes a filament supply 28. The X-ray driver supply receives a voltage control signal and a frequency control signal from the control device 25. The frequency control signal is connected to a first timer circuit 66 (see FIG. 4A). The first timer circuit 66 is preferably an astable free running oscillator. Control of the frequency is provided by an external voltage or by adjusting a potentiometer connected to the first timer. The voltage control signal is connected to a second timer circuit 68. The second timer circuit is preferably a monostable oscillator. The frequency control signal is passed through the first timer circuit 66 and to the second timer circuit 68. The second timer circuit 68 is connected to control the wiper arm of a switch 36. Control of the pulse width is provided by an external voltage or by adjusting a potentiometer connected to the second timer 68. The longer the pulse width the higher the voltage of the output pulse. The switch 36 is connected between a ground potential 70 and a primary winding 32 of a first transformer 30. Thus, when the signal from the second timer circuit 68 causes the wiper arm of the switch 36 to close, the circuit containing the first transformer 30 is closed and a current is caused to flow through the primary winding 32 of the first transformer 30. The flow of current through the primary winding 32 of the first transformer 30 stores energy in the transformer through the primary inductance, then when the first transistor shuts off this induces a current to flow in the secondary winding 34 of the first transformer 30. The secondary winding 34 is connected between a ground potential and the anode 72 of the X-ray tube 26. The current induced in the secondary winding 34 flows to the anode of the X-ray tube 26 causing the X-ray beam 16 to be generated. The primary and secondary windings 32 and 34, respectively, of the first transformer 30 preferably have a turns ratio of 1:77. The filament supply is also controlled by an external voltage or potentiometer and induces a current that flows through the cathode connected filament 40 and controls the amount of high voltage or emission current that flows from the anode 72 to the cathode 82 and to ground.

Figure 4:
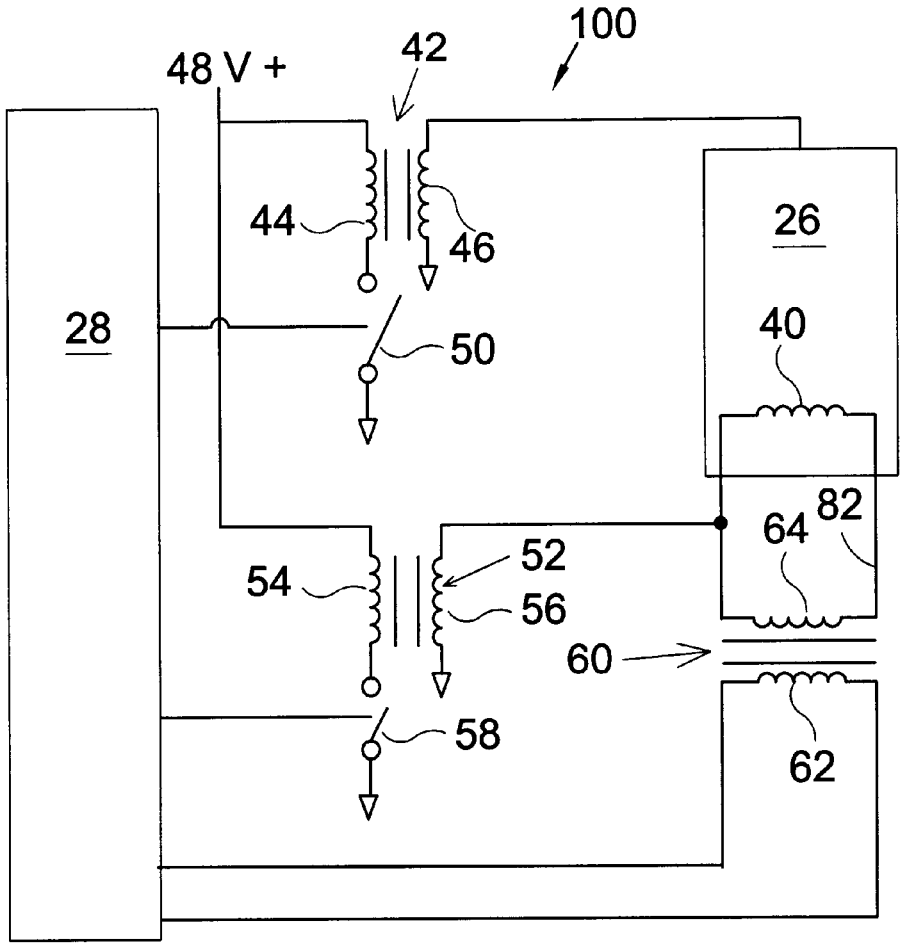
FIG. 4 is a block diagram of the X-ray tube driver of the present invention for generating power in a range of 0–80 kV.
Figure 4A:
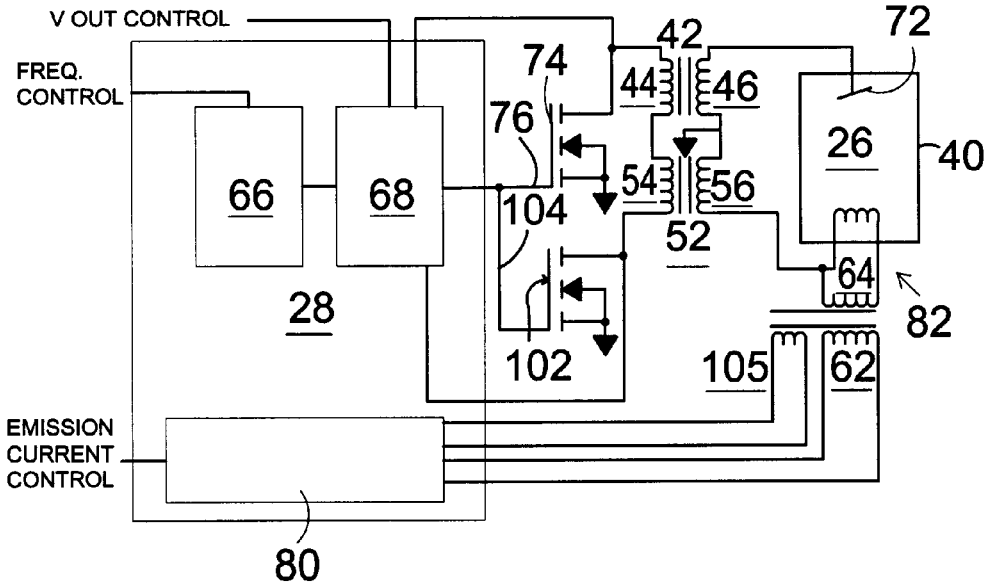
FIG. 4A is a schematic diagram of the X-ray tube driver of the present invention shown in FIG. 4.

The switch 36 is preferably a transistor 74 with the second timer 68 connected to the gate 76 of the transistor 74 (see FIG. 4A). An over current control circuit 78 is connected to the switch 36 to prevent the current from destroying the switch 36. A filament control and feedback circuit 80 is also contained within the X-ray driver 28 and is connected to the filament 82 of the X-ray tube 26 to provide a regulated DC current that can be controlled from 0 to 2 amps or more if necessary. The frequency control signal adjusts the first timer 68 to change the frequency of the pulses applied to the X-ray tube 26 through the secondary winding 34. Thus, the duty cycle of the X-ray beam 16 is controlled. The frequency can be controlled to be between a single shot to 400 Hz., and beyond in duration. By controlling the frequency, the number of pulses generated per second can be controlled. The voltage control signal is adjusted using an external voltage or a potentiometer connected to the second timer 66 to change the pulse width in the primary winding and thus the magnitude of the voltage induced in the secondary winding. Thus the magnitude of the voltage applied to the anode of the X-ray tube 26 and the intensity of the X-ray beam generated is also adjusted. The voltage of the pulse in this circuit can be adjusted to a value within the range of but not limited to 0–40 kV. The cathode 82 and filament of the X-ray tube 26 is referenced to ground in this embodiment.

Figure 3:
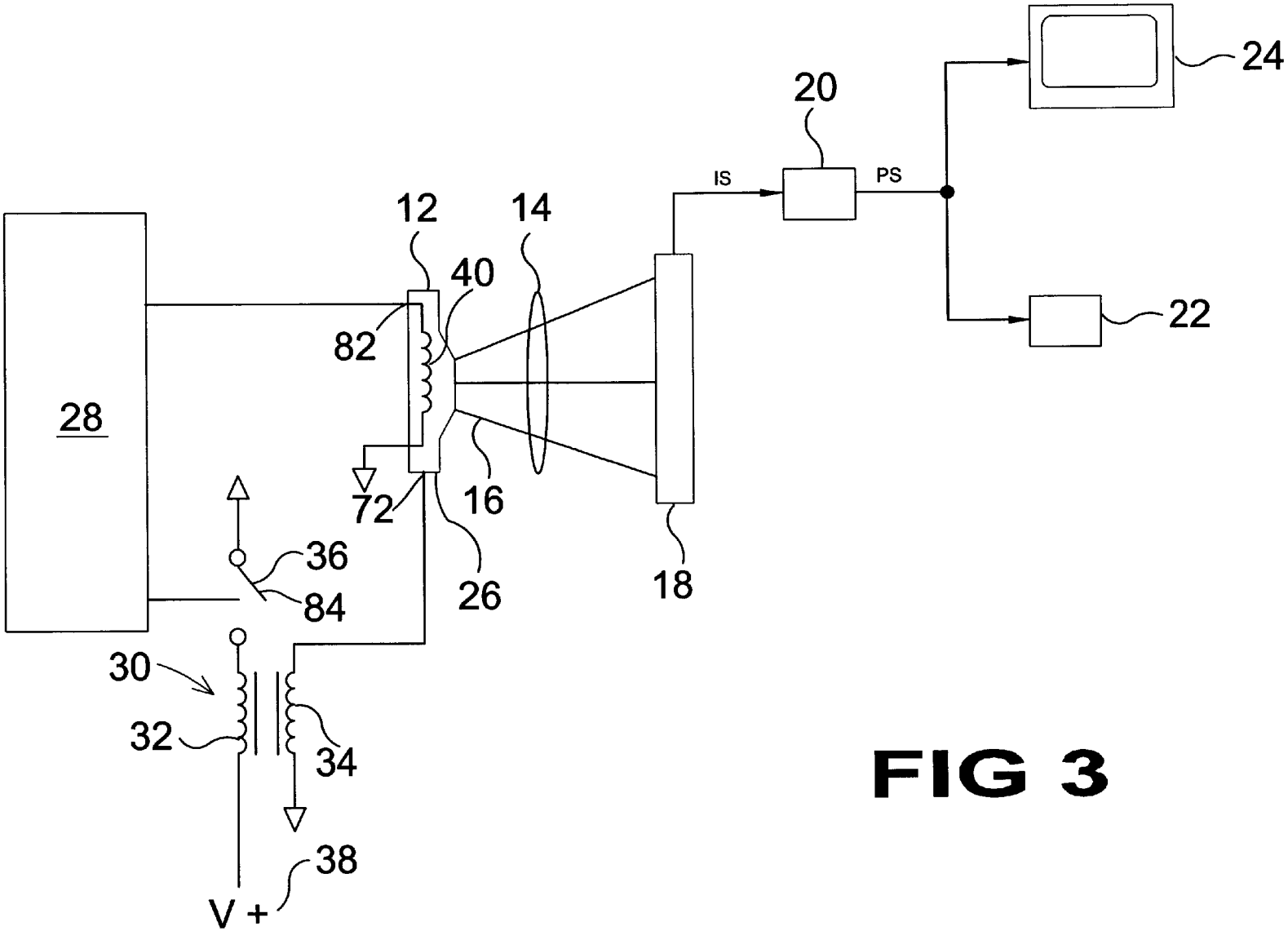
FIG. 3 is a perspective view of the X-ray tube driver shown in FIG. 2 connected to an X-ray examination apparatus for generating an X-ray.

FIG. 3 illustrates the X-ray tube driver 10 connected to the X-ray system of FIG. 1. As can be seen from this figure, the switch 36 is controlled by a signal from the driver control 28. The driver circuit 28 is also directly connected to the cathode 82. The control signal from the driver 28 controls the wiper blade 84 of the switch 36 to move between the open and closed positions. When in the open position, the primary winding 32 of the first transformer 30 is open circuited and disconnected from the driver 28 such that no current is supplied to the X-ray tube 26. When in the closed position, the primary winding 32 forms a closed circuit thereby allowing current to flow thereby causing energy to be stored in the transformer 30 when switch is opened the transformer flys back which induces a current to flow in the secondary winding 34 thereby supplying a current to the anode 72 of the X-ray tube 26. The current flowing through the X-ray tube 26 causes the X-ray beam 16 to be generated. Current flowing through the tube is indirectly controlled by the current flowing through the filament which is controlled by the filament supply.

The X-ray beam is directed at the screen 18 and produces an image thereon representative of the amount of the beam 16 able to pass through the object 14 positioned between the filament tube 26 and the screen 18. The screen 18 provides a signal representative of the image generated to the post processing unit 20. The post processing unit 20 processes the received signal and provides a processed signal to the buffer unit 22 and the monitor 24. The monitor 24 is able to display the image on a screen for viewing. The buffer unit 22 is able to connect with a peripheral device for outputting a signal representative of the image signal thereto.

Figure 5:
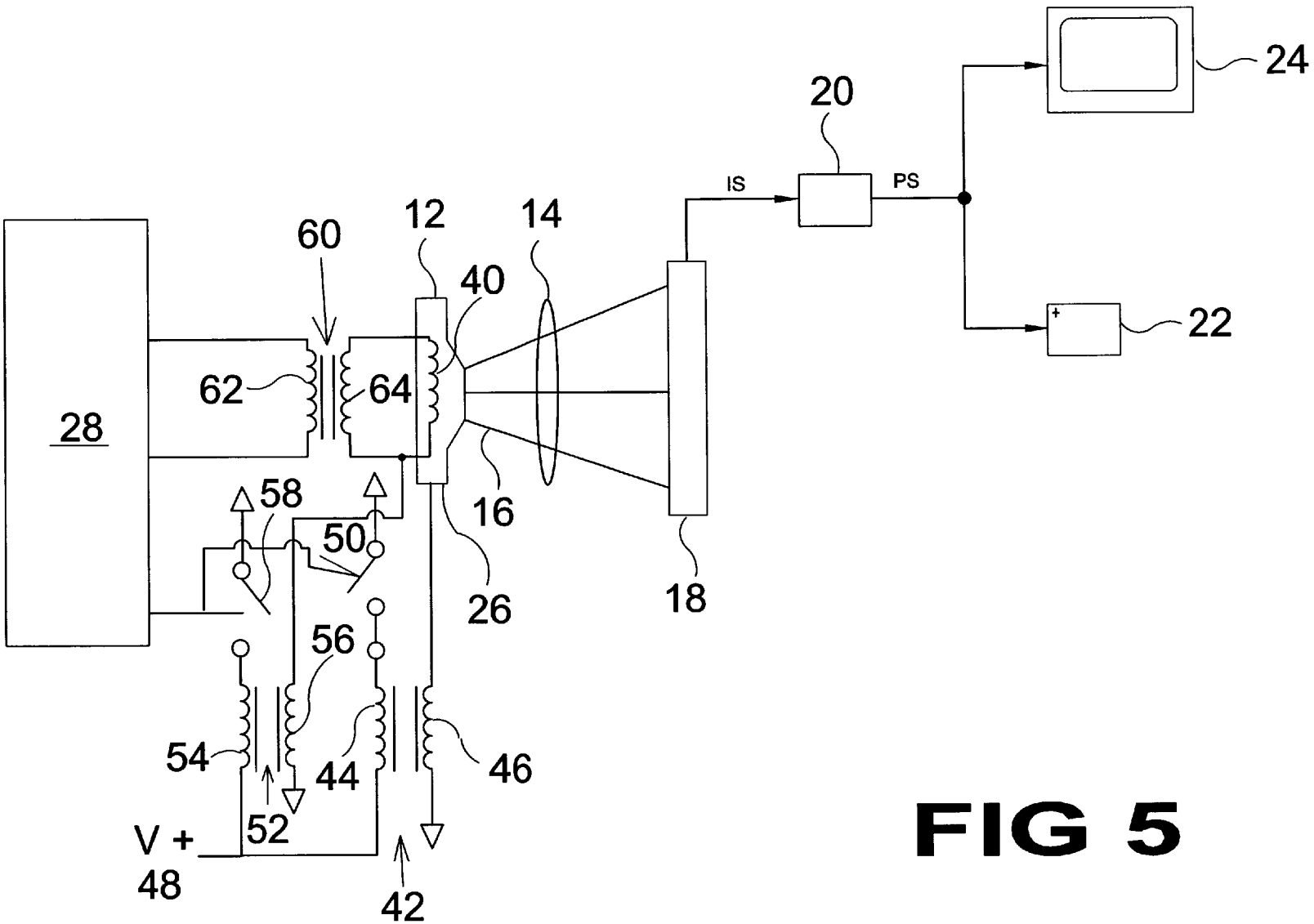
FIG. 5 is a perspective view of the X-ray tube driver shown in FIG. 4 connected to an X-ray examination apparatus for generating an X-ray.

The driver circuit 100 provides an additional transformer connected to the cathode 82. The cathode 82 in this instance is referenced to a negative 40 kV pulse thereby increasing the range for the high voltage pulse applied to the X-ray tube 26. The driver circuit 100 includes three high voltage transformers and is illustrated in FIGS. 4, 4A and 5. This circuit is able to generate a high voltage pulse within the range of but not limited to 0–80 kV, twice the range generated using a single high voltage transformer. This circuit 100 includes a first transformer 42, a second transformer 52 and a third transformer 60.

The first transformer 42, as also illustrated in FIGS. 1–3, includes the primary winding 44 coupled between the source of positive voltage 48 and the wiper arm of the first switch 50. The secondary winding 46 of the first transformer 42 is connected between the ground potential and the anode 72 of the X-ray tube 26. The first switch 50 is controlled by the driver control 28 to open and close thereby controlling the flow of current through the primary winding 44. The flow of current through the primary winding 44 causes a current to be induced in the secondary winding 46 which is applied to the anode 72 of the X-ray tube 26. The application of voltage to the X-ray tube 26 causes an X-ray beam to be generated.

A primary winding 54 of the second transformer 52 is also coupled to the voltage supply 48. A second terminal of the primary winding 54 is coupled to a terminal of a second switch 58. The second switch 58 is also controlled by a control signal received from the driver control 28 to open and close thereby controlling the flow of current through the primary winding 54. The second switch 58 is preferably a transistor 102 with the control signal received at its gate 104 from the second timer 68. The flow of current through the primary winding 54 causes a current change to be induced in the secondary winding 56 of the second transformer 52 which is applied to the cathode 82 of the X-ray tube 26. The current applied to the cathode 82 is a negative current and thus application of the current to the negative lead, i.e. The cathode 82, increases the range of voltages for the high voltage pulse and thus the voltage of the generated X-ray beam.

A secondary winding 64 of a third transformer 60 is connected in parallel with filament 40 connected to the cathode 82. The secondary winding 56 of the second transformer 52 is connected in series with this parallel connection and ground. The primary winding 62 of the third transformer 60 is controlled by the filament control and feedback circuit 80 of the driver 28. The filament supply 28 controls the application of a current to the third transformer and thus controls the inducement of current in the secondary winding 64 which applies the induced current to the filament 40 of the cathode 82 causing the X-ray tube 26 to develop an emission or high voltage current to flow and thus to generate the X-ray beam. The induced current in the secondary winding 64 of the third transformer 60 controls current in the X-ray tube 26. An auxiliary winding 105 on the third transformer serves as a feedback output control winding.

The X-ray tube driver circuit shown in FIGS. 4 and 4A is shown connected to a system for generating an X-ray image in FIG. 5. As can be seen from this figure, the first and second switches 50 and 58, respectively, are controlled to open and close by a signal received from the driver control 28. The third transformer 60 is connected directly to and controlled by a second signal from the filament circuit and is connected to supply a control current directly to the filament. The first transformer 42 receives a signal having a controllable frequency and pulse width from the driver control 28 when the first switch 50 is caused to close. The primary winding 44 of the first transformer 42 induces a current, as described previously, to flow in the secondary winding 46 thereof which is applied to the X-ray tube 26 for generating an X-ray beam 16. The intensity and pulse frequency of the X-ray beam 16 is controlled by the voltage induced in the secondary winding 46 which is directly related to the frequency and pulse width of the control signal from the driver control 28.

The second transistor 52 also receives a signal having a controllable voltage and pulse width from the driver control 28 when the second switch 58 is caused to close. The primary winding 54 of the second transformer 52 induces a current, as previously described, to flow in the secondary winding 56 thereof which is applied to the cathode 82 of the X-ray tube 26. The voltage applied by the secondary winding 56 of the second transformer 52 to the cathode 82 is a negative voltage and thus increases the potential difference between the anode 72 and cathode 82. The increase in the potential difference increases the apparent voltage applied to the anode 72 by the secondary winding 46 of the first transformer 52 and thus increases the intensity of the X-ray beam 16 generated thereby.

The third transformer 60 is connected in parallel configuration with the filament connected cathode 82. The parallel combination of the cathode and third transformer 60 is connected in series configuration with the secondary winding of the second transformer 52. The third transformer 60 is controlled by the filament control and feedback circuit 80 of the driver control 28 thus controlling the current applied to the filament 40.

The generated X-ray beam 16 is directed at the screen 18 and produces an image thereon representative of the amount of the beam 16 able to pass through the object 14 positioned between the X-ray tube 26 and the screen 18. Adjustment of the voltage control signal and frequency control signal control the voltage and pulse width of the current applied to the first and second switches 50 and 58, respectively and thus controls opening and closing of the switches. The current allowed to pass through the first and second switches 50 and 58, respectively, determine the amount of voltage induced in the secondary windings 46 and 56 of the first and second transformers 42 and 52. The induced voltage along with the current flowing in the filament then determines the intensity of the generated X-ray beam 16. The pulse width of the control signal provided to the first and second switches 50 and 58 determines the opening and closing of the switches 50 and 58 and thus the voltage and frequency of the pulses of the generated X-ray beam 16.

The screen 18 provides a signal representative of the image generated to the post processing unit 20. The post processing unit 20 processes the received signal and provides a processed signal to the buffer unit 22 and the monitor 24. The monitor 24 is able to display the image on a screen for viewing. The buffer unit 22 is able to connect with a peripheral device for outputting a signal representative of the image signal thereto.

The first transformer 42 is connected to the anode 72 using a spark plug cable or automotive ignition cable. Such cable is more resistive than inductive and the insulation of this cable has very little capacitance. This type of cable provides virtually no voltage drop across lengths of at least 15 feet and provides a very dampened ringing effect. Furthermore, running the X-ray tube with the X-ray tube driver of the present invention eliminates the need to submerge the X-ray tube in high voltage oil or encapsulation for high voltage isolation across the tube or heat sinking to dissipate heat created from the generation of the X-ray beam.

From the above description it can be seen that the X-ray tube driver of the present invention is able to overcome the shortcomings of prior art devices by providing a X-ray tube driver which is able to drive an X-ray tube directly using a high voltage transformer, providing a constant pulse to the X-ray tube without significant thermal buildup from the creation of X-rays. The X-ray tube driver provides an adjustable pulse of preferably but not limited to 0–40 kV or 0–80 kV to an X-ray tube. The X-ray tube driver which is also able to vary the frequency of pulses to thereby change the number of X-rays generated per second and vary the voltage of pulses and vary the current of the pulses thereby changing the amount of X-ray power and penetration through a desired object being X-rayed, the pulses may be varied over a set time to get the best possible image of the object being X-rayed. The X-ray tube driver can also pulse an X-ray tube with at least 70 watt pulses without heat sinking the tube and preventing voltage tracking across the tube. Furthermore, the X-ray tube driver of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A driver circuit for supplying power to an X-ray tube, said driver circuit comprising:

a) a driver control;

b) a first transformer connected to an anode of the X-ray tube; and c) a first switch connected between said driver control and said first transformer, wherein said driver control provides a control signal to said first switch for moving said switch between an open and closed position, said signal being adjustable in both frequency and pulse width whereby said control signal is applied to the X-ray tube via said first transformer after said first switch has closed and opened to generate an X-ray beam which is adjustable in both intensity and frequency.

2. The X-ray tube driver as recited in claim 1, wherein said first switch is a transistor.

3. The X-ray tube driver as recited in claim 1, wherein said first transformer includes a primary winding connected to receive said control signal from said first switch and a secondary winding connected to an anode of the X-ray tube, wherein said first signal being applied to said primary winding causes a current to be induced in said secondary winding, said induced current being applied to the anode of the X-ray tube for generating an X-ray beam.

4. The X-ray tube driver as recited in claim 3, wherein the primary and secondary windings preferably have a turns ratio of 1:77.

5. The X-ray tube driver as recited in claim 2, wherein said driver control includes a first timer and a second timer, said second timer being connected to provide said control signal to a gate terminal of said transistor.

6. The X-ray tube driver as recited in claim 5, wherein said first timer is an astable free running oscillator and control of frequency is provided by adjusting an external voltage or a potentiometer connected to said astable free running oscillator.

7. The X-ray tube driver as recited in claim 6, wherein said second timer is a monostable oscillator and control of pulse width and thus voltage is provided by adjusting an external voltage or a potentiometer connected to said monostable oscillator.

8. The X-ray tube driver as recited in claim 1, wherein said first transformer is connected to the anode of the X-ray tube via a cable which is more resistive than inductive and has minimal capacitance.

9. The X-ray tube driver as recited in claim 1, wherein said driver circuit is able to provide a high voltage pulse having a width within a range of 100–200 $\mu$sec.

10. The X-ray tube driver as recited in claim 2, further comprising an overcurrent control circuit coupled to a source of said first transistor for protecting said first transistor.

11. The X-ray tube driver as recited in claim 1, further comprising a second switch and a second transformer connected between said second switch and a cathode of the X-ray tube.

12. The X-ray tube driver as recited in claim 11, wherein said second switch is a transistor, a gate of said transistor being connected to receive said control signal from said driver control.

13. The X-ray tube driver as recited in claim 12, further comprising a third transformer connected in parallel with the filament of the X-ray tube.

14. The X-ray tube driver as recited in claim 13, wherein said second transformer is connected in series with the parallel connection of said third transformer, cathode and ground potential.

15. The X-ray tube driver as recited in claim 13, wherein said third transformer is controlled by a signal from a filament control and feedback circuit.

16. The X-ray tube driver as recited in claim 11, wherein said high voltage pulse is adjustable to generate a voltage within a range of 0–40 kV.

17. The X-ray tube driver as recited in claim 11, wherein said driver circuit is able to provide a high voltage pulse having a width within a range of 100–200 $\mu$sec.

18. The X-ray tube driver as recited in claim 17, wherein said high voltage pulse is adjustable to generate a voltage within a range of 0–80 kV.

19. The X-ray tube driver as recited in claim 11, wherein said first transformer is connected to the anode of the X-ray tube via a cable which is more resistive than inductive and has minimal capacitance.

20. The X-ray tube driver as recited in claim 11, wherein said second transformer is connected to the cathode of the X-ray tube via a cable which is more resistive than inductive and has minimal capacitance.

21. The X-ray tube driver as recited in claim 20, wherein said second transformer is connected to the cathode of the X-ray tube via a cable which is more resistive than inductive and has minimal capacitance.

* * * * *